United States Patent [19]

Norton

[11] 4,251,071

[45] Feb. 17, 1981

[54] EXERCISING DEVICE WITH COMPRESSIBLE HAND GRIP ON AN ELASTIC CARD

[76] Inventor: Craig D. Norton, 4844 Trinidad Ave., Oakland, Calif. 94602

[21] Appl. No.: 934,690

[22] Filed: Aug. 17, 1978

[51] Int. Cl.[3] ..... A63B 21/02

[52] U.S. Cl. ..... 272/137; 272/143; 272/68

[58] Field of Search ..... 272/137, 142, 143, DIG. 3, 272/DIG. 4, 135, 131; 224/45 R, 45 P, 45 W, 45 C; 188/65.1; 182/15, 13; 273/75

[56] References Cited

U.S. PATENT DOCUMENTS

| | | | |
|---|---|---|---|
| 232,680 | 9/1880 | Cammann | 224/45 P |
| 675,788 | 6/1901 | Oakley | 188/65.1 |
| 2,118,114 | 5/1938 | Schenk | 272/142 |
| 2,200,626 | 5/1940 | Lamkin | 273/75 |
| 2,448,384 | 8/1948 | Meinzinger | 188/65.1 |
| 3,807,730 | 4/1974 | Dalton et al. | 272/68 X |
| 4,057,246 | 11/1977 | Wilson | 272/137 |
| 4,109,905 | 8/1978 | Meier | 272/143 |

FOREIGN PATENT DOCUMENTS

| | | | |
|---|---|---|---|
| 9327 | 11/1894 | Switzerland | 272/137 |

*Primary Examiner*—Richard C. Pinkham
*Assistant Examiner*—William R. Browne
*Attorney, Agent, or Firm*—Alvin E. Hendricson; William R. Piper

[57] ABSTRACT

The exercising device comprises an elongated elastic cord with a foot-receiving loop formed at each end and a hollow hand grip with an axial bore extending from end to end with a longitudinally extending split permitting one or two lengths of the elastic rope to be inserted into the bore. The hand grip may be squeezed by the hand for causing the wall of the bore to frictionally grip the rope. The hand muscles are exercised by this squeezing action on the hand grip and the arm and shoulder muscles are exercised when the hand grip pulls on the rope to elongate it.

2 Claims, 8 Drawing Figures

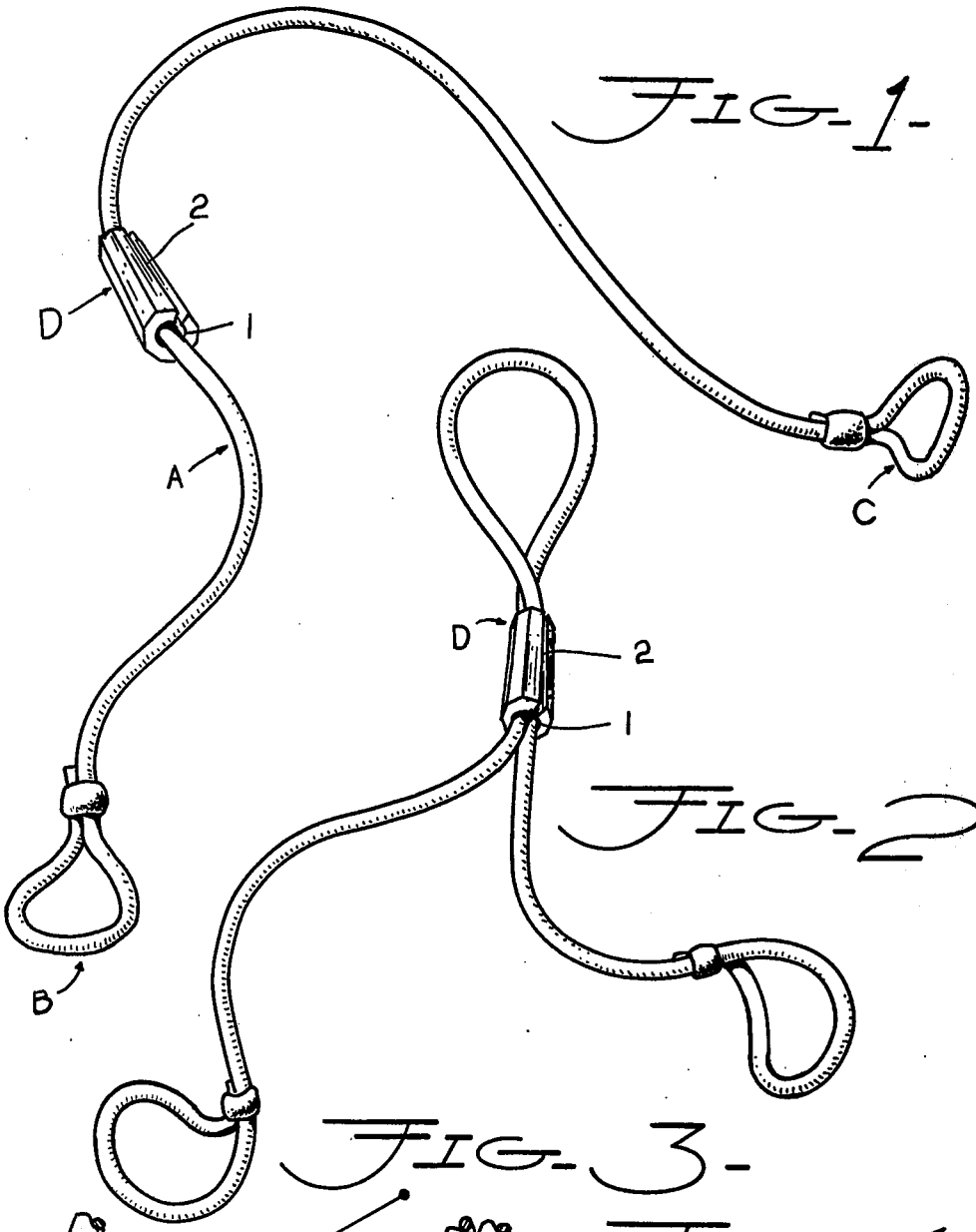
FIG-1-
FIG-2-
FIG-3-
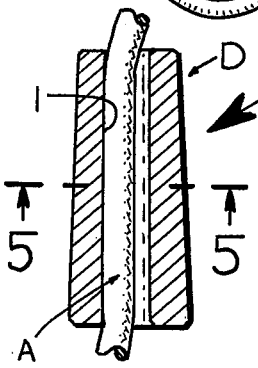
FIG-4-
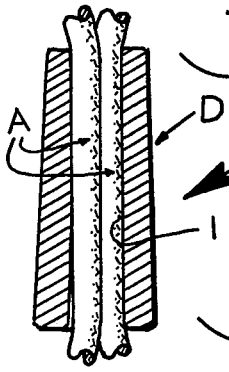
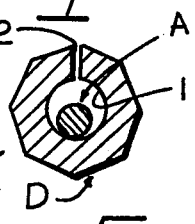
FIG-5-

EXERCISING DEVICE WITH COMPRESSIBLE HAND GRIP ON AN ELASTIC CARD

SUMMARY OF THE INVENTION

An object of my invention is to provide an exercising device that permits one to exercise his muscles without the use of external objects to anchor it. The end loops of the elastic cord are anchored to one or both feet, this depending upon the particular exercise being practiced and the hand grip is held in the hand. The axial bore of the hand grip is made large enough in diameter to receive two portions of the elastic cord so that the operator can pull on two cord lengths instead of one should he wish to increase the resistance of the exercising device. Both loops are placed over the foot or hand to act as an anchor.

BRIEF DESCRIPTION OF THE DRAWINGS

FIG. 1 illustrates the exercising device with a single elastic cord extending through the axial bore in the resilient hand grip and each end of the cord provided with a loop.

FIG. 2 is similar to FIG. 1, except that two portions of the elastic cord are received in the axial bore of the hand grip.

FIG. 3 is an enlarged longitudinal section through the hand grip and one cord portion is received in the axial bore.

FIG. 4 is like FIG. 3, but shows two elastic cord portions placed in the axial bore.

FIG. 5 is a transverse section taken along the line 5—5 of FIG. 3.

DESCRIPTION OF THE PREFERRED EMBODIMENT

In carrying out my invention I show the exercising device in FIG. 1. The elastic cord A, is preferably ten, twelve or fourteen feet in length although I do not wish to be confined to any exact measurement or material. I have found that the thickness of the cord should be one-fourth inch to three-eighths of an inch in diameter. At each end of the cord I form a loop shown at B, and C and these loops are large enough to receive the foot or hand of the operator to which the cord may be anchored during the use of the device in various exercises.

A resilient hand grip D, is shown in detail in the sectional views of FIGS. 3, 4 and 5. The hand grip can be of various shapes, such as in the shape of a tennis racquet handle, golf club handle, etc. It should be about six inches long and about one and one-fourth inches in outer diameter although again I do not wish to be confined to any exact size. The resilient hand grip may be made from a rubberized material or any other material that may be compressed when the grip is squeezed by the operator's hand that holds it.

The important features of the hand grip is that it has an axial bore 1 extending throughout the length of the grip and it has a radial cut 2, the plane of the cut extending outwardly from the grip axis and being coextensive with the length of the bore 1. I have found that for the best results the diameter of the bore should be about five eighths of an inch but I do not want to be limited to this precise measurement. The bore 1 can receive one portion of the cord A, as shown in FIGS. 3 and 5, or it may receive two portions as illustrated in FIG. 4. The outer surface of the hand grip may be of any shape desired. In FIGS. 3 to 5, inclusive, I have shown the grip D to simulate a tennis racquet handle which is octagonal shaped in cross section and has a slight taper from one end to the other. The cord A can have one or two lengths inserted into the bore 1 or removed therefrom by spreading the cut 2 to permit the passing of the cord lengths therethrough. The resiliency of the material forming the hand grip is sufficient to keep the two walls of the cut 2 in contact with each other to prevent the accidental removal of the cord from the hand grip.

The exercising device may be used for a number of different exercises. It has specifically been designed to exercise various muscles of the body such as the wrist, elbow and shoulder. The exerciser allows resistance to occur through several axes at one joint during an exercise. This is made possible because of the design of the resilient hand grip D and the way it is connected to the elastic cord A. The grip can be moved to any desired position along the cord and will only frictionally grip the cord when the resilient grip is squeezed to compress the wall of the bore 1 against the cord.

Figure 6:
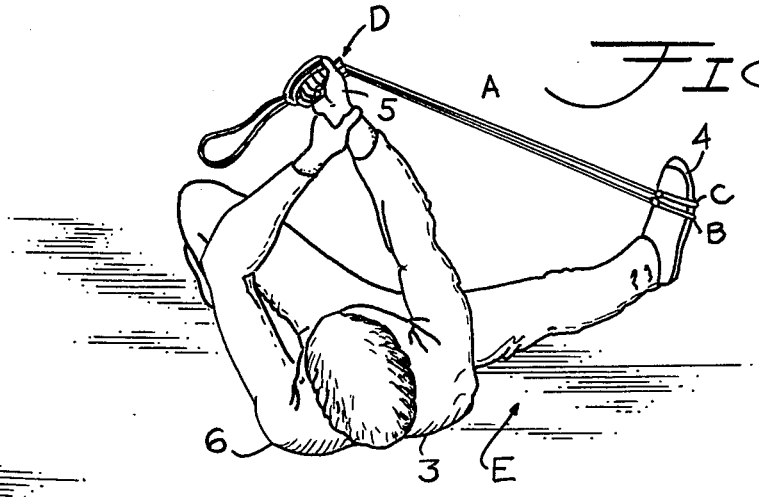
FIGS. 6, 7 and 8 illustrate a few of a great many physical exercises that may be performed with the device.
Figure 7:
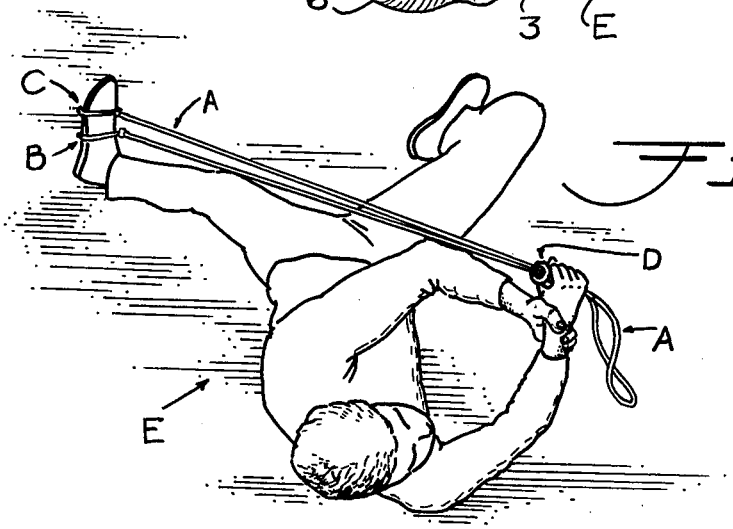
Figure 8:
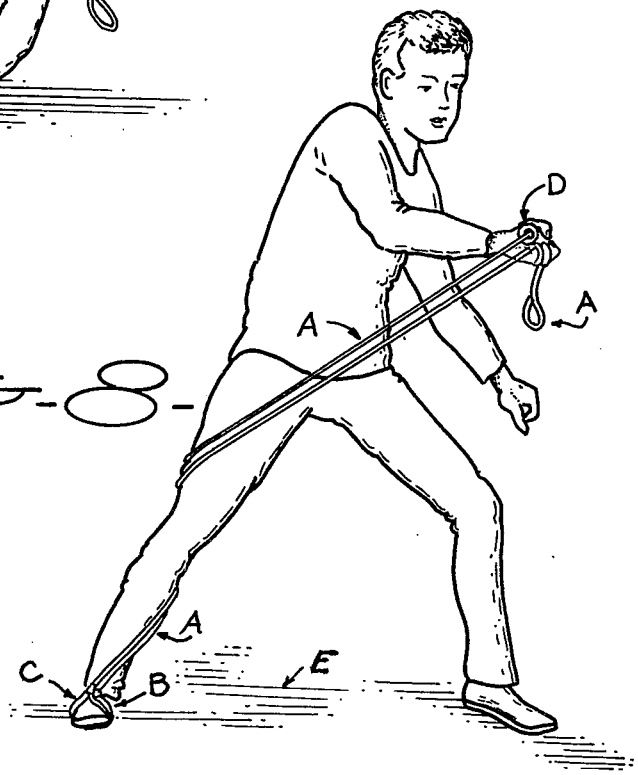

In FIGS. 6 to 8 inclusive, I illustrate a series of exercises especially designed to strengthen the muscles used by a person who plays tennis. The player lies on the floor with his back 3 resting on the floor E. He anchors both loops B and C to his right foot 4 and encloses two portions of the cord A, in the axial bore 1 of the resilient hand grip D, see FIG. 6, and the sectional view of the grip in FIG. 4. Then he grasps and squeezes the grip with his right hand 5 to cause the grip to frictionally hold on the two cord portions. A pull on the grip D, away from his foot 4 will tension the two portions. This exercise is for the forehand stroke in playing tennis and the pulling of the grip from the right foot 4 to the left shoulder 6 of the person will exercise the persons trunk muscles as well as the muscles of the right shoulder, elbow and wrist of the right arm. It will be seen that this single exercise permits resistance to occur through several axes at one time and the wrist, elbow and shoulder are worked upon during the exercise.

FIG. 8 illustrates a slightly different exercise for the forehand for playing tennis. In this view the player is standing upright and the two cord portions A, are wrapped once around the person's right leg. The grip D, is squeezed by the player's right hand and his right arm is swung away from the right hand side to the left hand side of the person. This will exercise the right leg muscles, trunk and right shoulder muscles as well as the elbow and wrist.

The illustration of FIG. 7 is for the person to exercise for the back hand stroke in tennis. Again, the person is lying on his back on the floor E, and the two loops B and C of the cord A, are attached to the left foot. The grip D, is pulling on two cord portions. The person's wrist is exercising against resistance in the combined movements of external rotation, abduction and extension. The right elbow of the person is exercised against resistance in the combined movements of extension and external rotation and the right shoulder is exercised against resistance in the combined movements of external rotation and horizontal abduction.

Other exercises for different games could be illustrated, but the three examples for exercising muscles used in playing tennis are thought to be sufficient. Very important is the fact that the exercising device allows one to exercise in patterns of movements specific to unilateral sports such as tennis and racquetball. This permits one to facilitate and integrate the neurological and muscular systems to improve both strength and coordination. Groups of muscles are simultaneously exercised in patterns when using the exercising device rather than strengthen a specific muscle. This is an important factor for conditioning in a unilateral sport.

The specially designed resilient hollow hand grip with its longitudinal slit 2 to receive the one or two portions of the elastic cord A, helps the person to strengthen his grip and this is an important factor when conditioning muscles for the playing of tennis, racquetball and golf. If the hand grip D, is not squeezed hard enough as one carries out the exercise, the hand grip will disengage from the cord and slide along it and all resistance generated by the tensioning of the cord will be lost.

The exercising device was designed to exercise groups of muscles in patterns kineseologically disected from a unilateral sport (a sporting activity that uses mostly one side of the body), and was not designed to exercise a specific muscle. Exercising in patterns of movement allows the development of neuro-muscular system simultaneously, a necessary element for acquiring coordination and conditioning. My exerciser permits immediate resistance to occur in external and internal rotation of the wrist and elbow joint and this is a very important factor when training for unilateral sports such as tennis and racquetball.

I claim:

1. An exercising deviced comprising:

(a) an elastic cord having a loop at each end to permit the loops to fit over one or both feet or be grasped in the hand of the one using the device;

(b) a resilient hand grip means having an axial bore extending throughout its length with a radial cut coextensive with the bore and extending from the bore outwardly to the periphery of the hand grip means so that the two walls of the radial cut may be forced apart to permit the entrance of one or two elastic cords into the bore;

(c) said hand grip means being squeezed by the user with sufficient strength to frictionally connect said grip means to said cord or cords, whereby the hand muscles are exercised; and (d) said hand grip means thus frictionally gripping the cord or cords can be pulled to elongate the cord or cords, thereby simultaneously exercising the arm and body muscles coordinated with the exercise.

2. The combination as set forth in claim 1 further defined by the peripheral surface of said hand grip means being formed in the shape of the handle of an instrument employed in a particular unilateral sport such as a tennis racket or a golf club for use of the device in a series of exercises for groups of muscles employed in said particular sport.

* * * * *